US006347621B1

(12) United States Patent
Guthrie

(10) Patent No.: US 6,347,621 B1
(45) Date of Patent: Feb. 19, 2002

(54) PROJECTILE FEED MECHANISM FOR A BLOWGUN

(76) Inventor: Christopher L. Guthrie, P.O. Box 98, Henryville, IN (US) 47126

( * ) Notice: Subject to any disclaimer, the term of this patent is extended or adjusted under 35 U.S.C. 154(b) by 0 days.

(21) Appl. No.: 09/689,410

(22) Filed: Oct. 12, 2000

(51) Int. Cl.[7] ..... F41B 1/00; F41B 11/02
(52) U.S. Cl. ..... 124/48; 124/49; 124/62
(58) Field of Search ..... 124/48, 49, 50, 124/51.1, 62

(56) References Cited

U.S. PATENT DOCUMENTS

| | | | | | |
|---|---|---|---|---|---|
| 278,005 | A | * | 5/1883 | Fredricks et al. | |
| 921,764 | A | | 5/1909 | Wheeler | 124/62 |
| 1,743,576 | A | | 1/1930 | Smith | 124/72 |
| 2,147,003 | A | | 2/1939 | Von Kozurik | 124/72 |
| 2,437,728 | A | | 3/1948 | Drumheller | 124/48 |
| 2,888,003 | A | * | 5/1959 | Swanson | |
| 3,009,703 | A | | 11/1961 | Jentsch et al. | 273/356 |
| RE29,479 | E | | 11/1977 | Mohr | 124/1 |
| 4,834,058 | A | | 5/1989 | Gegere | 124/29 |
| 4,986,251 | A | | 1/1991 | Lilley | 124/67 |
| 5,097,985 | A | * | 3/1992 | Jones | 124/48 X |
| 5,413,083 | A | | 5/1995 | Jones | 124/32 |
| 5,490,493 | A | | 2/1996 | Salansky | 124/78 |
| 5,520,171 | A | | 5/1996 | David | 124/51.1 |
| 5,544,642 | A | | 8/1996 | Guthrie | 124/62 |
| 5,722,383 | A | | 3/1998 | Tippmann, Sr. et al. | 124/76 |
| 5,749,797 | A | * | 5/1998 | Sunseri et al. | 124/51.1 X |
| 5,816,232 | A | | 11/1998 | Bell | 124/51.1 |
| 5,850,826 | A | | 12/1998 | Guthrie | 124/62 |
| 5,887,578 | A | | 3/1999 | Backeris et al. | 124/49 |
| 5,947,100 | A | | 9/1999 | Anderson | 124/45 |
| 5,954,042 | A | | 9/1999 | Harvey | 124/51.1 |

* cited by examiner

*Primary Examiner*—John A. Ricci
(74) *Attorney, Agent, or Firm*—Woodard, Emhardt, Naughton, Moriarty & McNett

(57) ABSTRACT

A device for feeding projectiles to a gun barrel includes a hopper for containing projectiles for feeding to a housing. The housing has an outlet communicating with the gun barrel and an indexed loading disk mounted at the outlet over a flat housing floor. The loading disk has a number of projectile spaces for receiving projectiles, and the disk is selectively positionable at index positions with the spaces over the outlet to gravity feed projectiles into the gun barrel. A trigger assembly is coupled to the loading disk and includes a ratchet to engage fins on the disk to sequentially rotate the disk to the index positions to drop projectiles into the barrel. The trigger also includes a projection for substantially continually engaging a corresponding slot on the disk for holding and stabilizing the disk in the housing during operation. The device is configured to be used to sequentially load a single paintball to a blowgun by successive pulls of the trigger. The device includes a tab substantially covering a hole in the disk to prevent more than one ball from being loaded at a time.

24 Claims, 11 Drawing Sheets

PROJECTILE FEED MECHANISM FOR A BLOWGUN

BACKGROUND OF THE INVENTION

The present invention relates to projectile apparatus and feed mechanisms therefore. More particularly but not exclusively, the present invention relates to a paint ball blowgun and a feed mechanism for a paint ball blowgun.

When firing projectiles, and in particular when engaging in the sport of paintball, it is desirable to be able to rapidly fire a successive round after firing a first round. Accordingly, many weapons are adapted for automatic or semiautomatic operation such that multiple rounds can be fired in a short period of time. However, many of these prior art mechanisms are complicated and costly, requiring numerous parts and associated interconnections, and they can be unreliable and prone to failure. Others depend integrally on an explosion or other mechanical burst of air from the firing mechanism and are consequently ineffective for use with a blowgun or other human powered weapon.

Accordingly there is a need for a novel feed mechanism that can reliably load projectiles to a gun barrel. There is also a need for a feed mechanism that is lightweight, portable, and easily assembled and does not block the operator's line of sight. There is also a need for a feed mechanism that can load projectiles in a simple and cost effective manner. There is also a need for a feed mechanism that does not hinder the firing ability, accuracy, or range of the weapon. Finally there is a need for a feed mechanism that can be used with a blowgun.

Some of these needs are met by various embodiments of the present invention.

SUMMARY OF THE INVENTION

In one aspect there is provided a device for feeding projectiles to a gun barrel including; a hopper for containing projectiles, a housing communicating with the hopper and including an outlet communicating with the gun barrel, an indexed loading disk mounted at the outlet and having a number of projectile spaces, and a trigger assembly coupled to the loading member to rotate the loading member to one of the index positions having one of the spaces over the outlet to transfer a projectile to the gun barrel.

In another aspect there is provided a projectile feeder for a blowgun including: a housing with an outlet communicating with a blowgun barrel, a loading member rotatably mounted at the outlet to rotate about an axis substantially not parallel to the blowgun barrel, where the loading member has a number of projectile spaces and is selectively positionable with each of the plurality of spaces in communication with the outlet to load a projectile into the blowgun barrel, and a manually operated trigger assembly to sequentially rotate the loading member a predetermined amount for each operative stroke of the trigger assembly.

In another aspect there is provided a method of loading a gun including: providing a gun and a number of projectiles, providing a projectile feeder with a housing having an outlet, a loading member with a number of projectile spaces selectively positionable over the outlet, a projectile supply hopper, and a trigger for rotating the loading member to load the gun barrel, the trigger not also controlling the firing of the gun, sequentially indexing the loading member by activating the trigger to load projectiles to the gun barrel without also automatically firing the gun.

DESCRIPTION OF THE PREFERRED EMBODIMENT

For the purposes of promoting an understanding of the principles of the invention, reference will now be made to certain preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
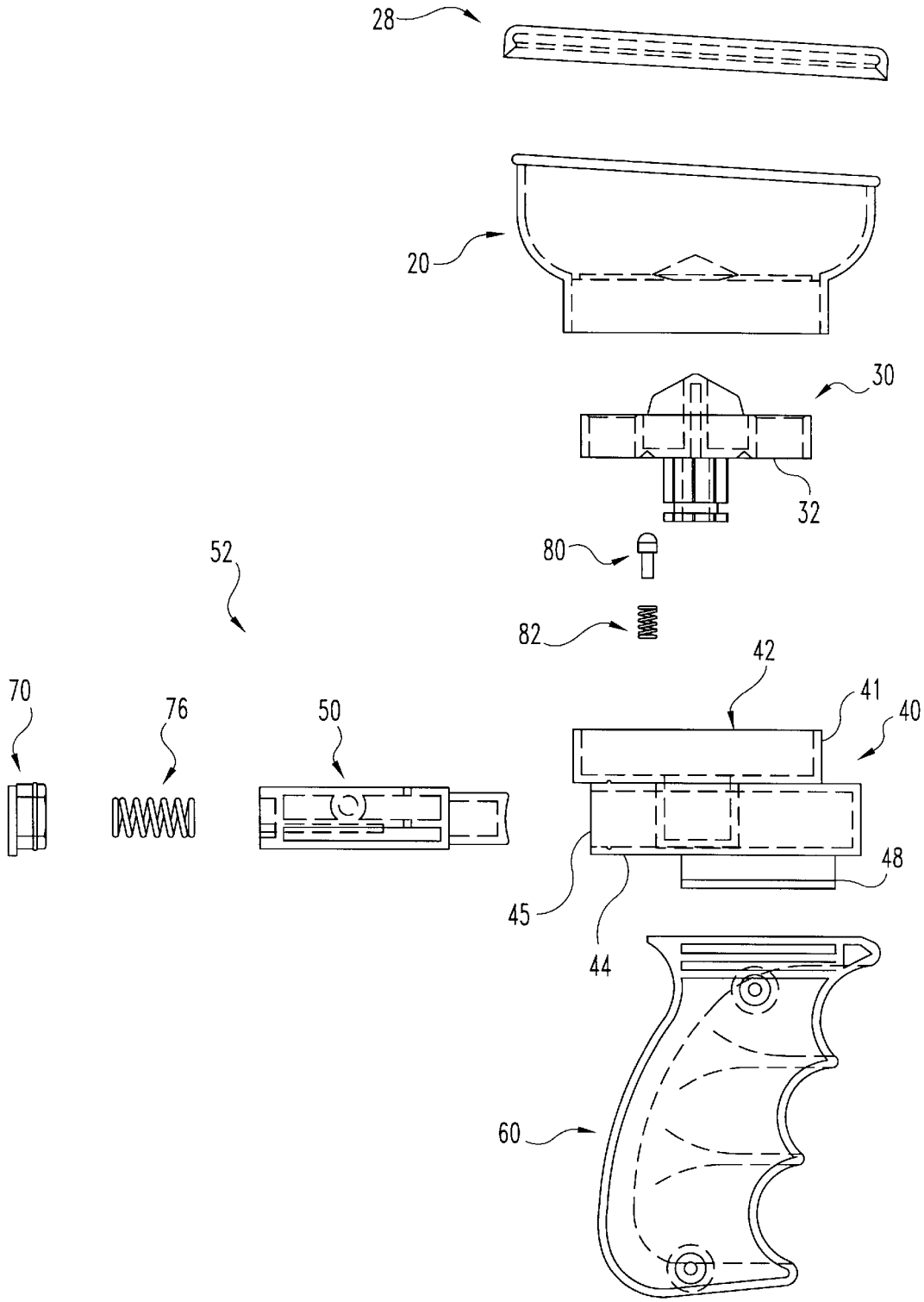
FIG. 1 is a side assembly view of a projectile feed mechanism according to one embodiment of the present invention.

Turning now to the figures, preferred embodiments of the present invention are illustrated. FIG. 1 is an assembly view showing various components of a feeding mechanism according to one embodiment of the present invention. The illustrated mechanism includes a housing 40 including a disk receiving portion 41. The disk receiving portion 41 defines a chamber 42 into which loading disk 30 having a plurality of loading holes 32 is rotatably received.

Hopper 20 is placed over housing portion 41 and is covered by lid 28, to be filled at least partially with projectiles, for example paintballs, pellets, or the like. The projectiles fit into holes 32 in loading disk 30. In the illustrated embodiment, housing 40 has trigger portion 44 for receiving a trigger assembly 52 into its distal end 45. Housing 40 additionally includes a passage 86 from chamber 42 to a barrel portion 49 (see FIG. 6 and 7A), and, as described in detail below, trigger assembly 52 operates on loading disk 30 to rotate disk 30 to sequentially transfer projectiles from hopper 20 through passage 86 and into a firing position in barrel 49.

Figure 2:
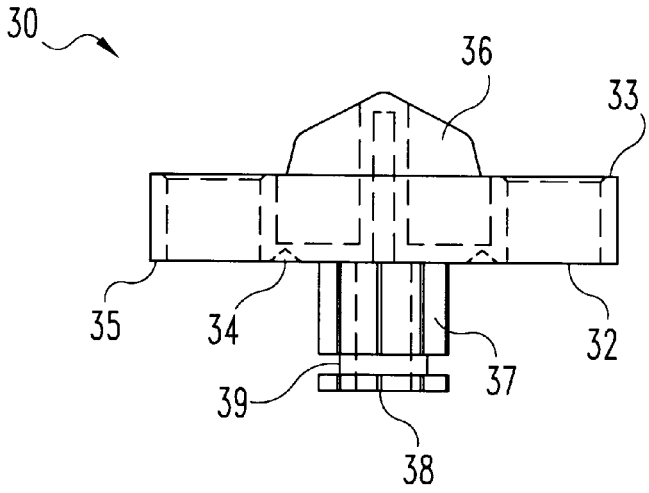
FIG. 2 is a side elevational view of a loading disk for the FIG. 1 feed mechanism.
Figure 3:
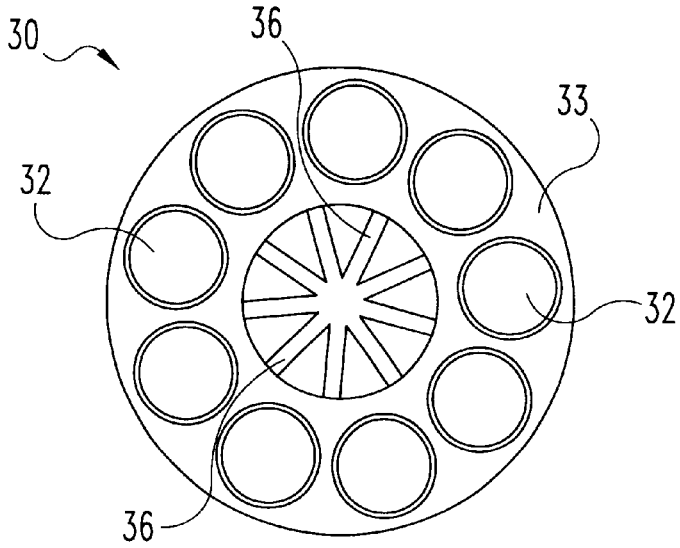
FIG. 3 is a top view of the FIG. 2 loading disk.
Figure 4:
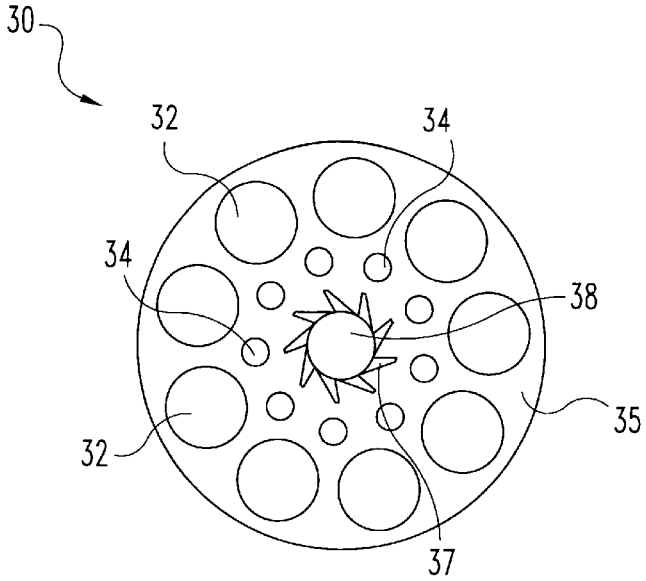
FIG. 4 is the bottom view of the FIG. 2 loading disk.
Figure 5:
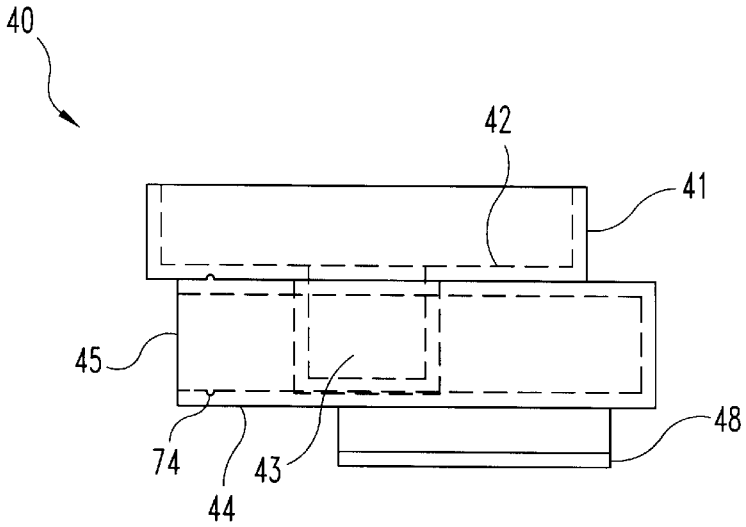
FIG. 5 is a side view of the housing of the FIG. 1 feed mechanism.

Turning to FIGS. 2–4 more particular aspects of the loading disk 30 are illustrated. Loading disk 30 includes a generally cylindrical body including a top surface 33, a bottom surface 35, and a plurality of holes 32 extending through disk 30 from surface 33 to surface 35. Holes 32 are tapered with respect to the top surface 33 and are equally spaced about the center of loading disk 30. Holes 32 are sized as appropriate for the particular projectiles being used, preferable one projectile per hole 32. In addition, preferably, though not essentially, holes 32 are distinct from each other, being completely separated from adjacent ones of the holes 32 by a portion of disk 30.

Mixing paddles 36 extend upward from the top surface 33 of disk 30. When disk 30 is rotated, paddles 36 serve to agitate any projectiles that are above surface 33, for example those projectiles placed in hopper 20, to facilitate placement of the projectiles into disk holes 32. Generally though not essentially, mixing paddles 36, like holes 32, are symmetrical about the center of loading disk 30.

Disk 30 is constructed for rotation within housing chamber 42 and includes cylindrical post 38 extending rigidly from bottom surface 35. Ratchet fins 37 are rigidly positioned about the post 38 and along generally the entire length of post 38 below surface 35. Fins 37 are removed or at least substantially diminished along a portion of post 38 to provide slot 39. As described below, ratchet fins 37 provide an engagement point for a corresponding ratchet 54 on trigger assembly 52 (see FIG. 9) to facilitate rotation of loading disk 30 within chamber 42.

As shown in FIG. 4 the underside of loading disk 30 further includes a number of index holes 34 in bottom surface 35. Holes 34 are tapered and sized to receive a corresponding index pin 80 to yielding lock disk 30 at selected angular positions. These selected angular or index positions generally correspond to the transfer of the contents of a single hole 32, namely a single projectile, into firing position in barrel 49. Accordingly, generally although not essentially, ratchet fins 37, index holes 34, and holes 32 are of equivalent number and spacing about the center of disk 30 so as to transfer a single projectile to barrel 49 at each index position.

Turning now to FIGS. 5–7A with continued reference to FIGS. 1–4 more particular features of housing 40 are illustrated. As illustrated and discussed above, housing portion 41 is formed to provide chamber 42 to receive disk 30 with the bottom surface 35 of disk in contact with the lower surface of chamber 42. Consequently, the housing 40 is provided with portion 43 below portion 42 to accommodate the lower post 38 and fins 37 of disk 30.

Figure 6:
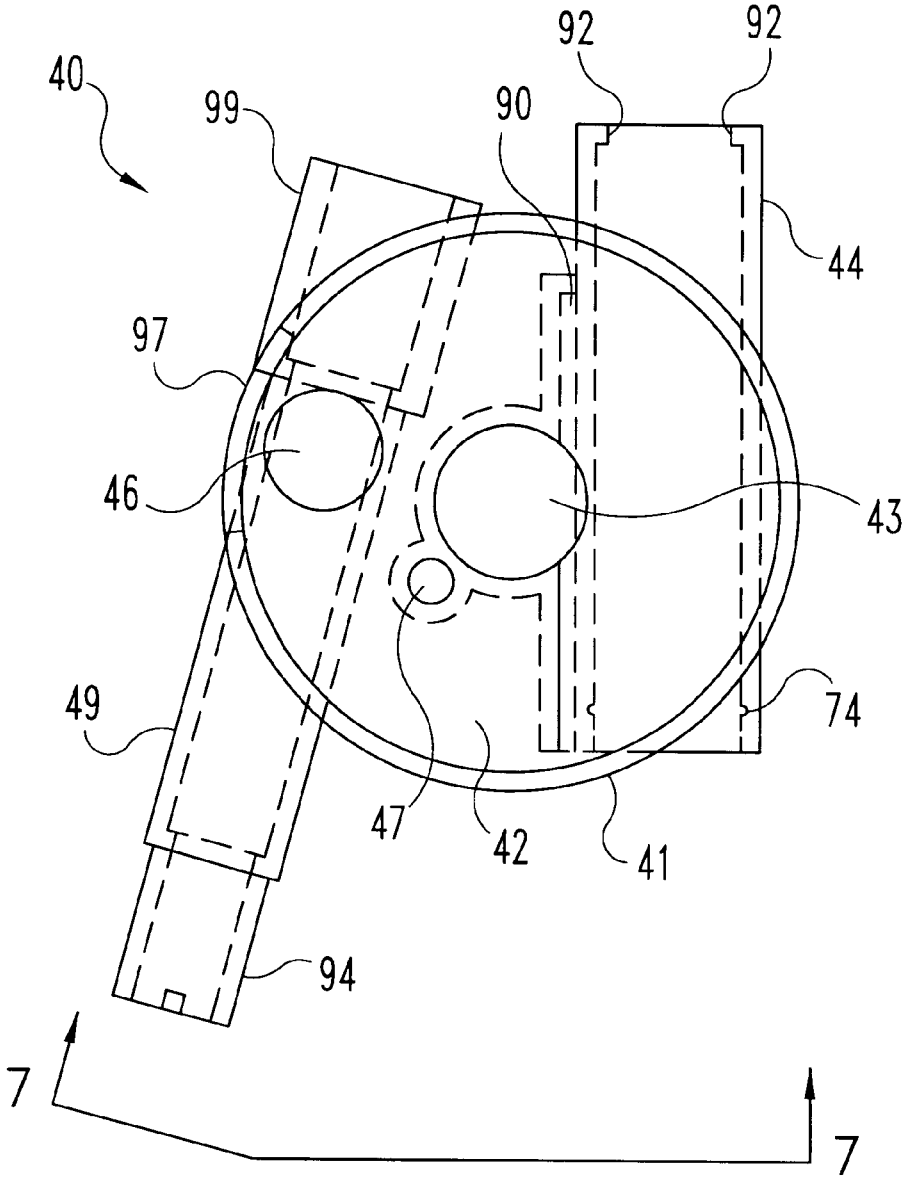
FIG. 6 is a top view of the housing of FIG. 5.
Figure 7:
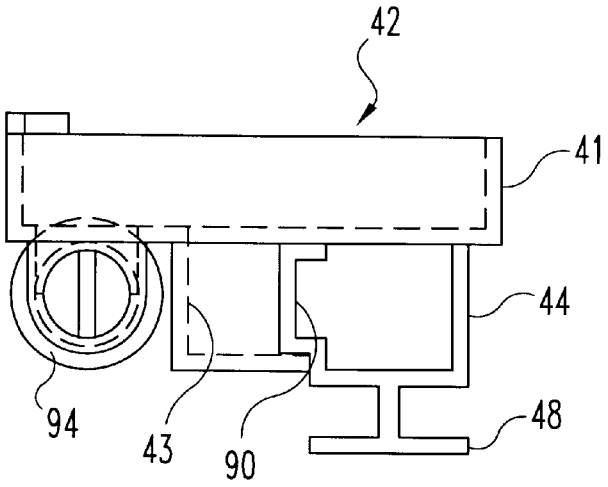
FIG. 7 is a rear view along line C of FIG. 6 with the barrel rotated for clarity.
Figure 7A:
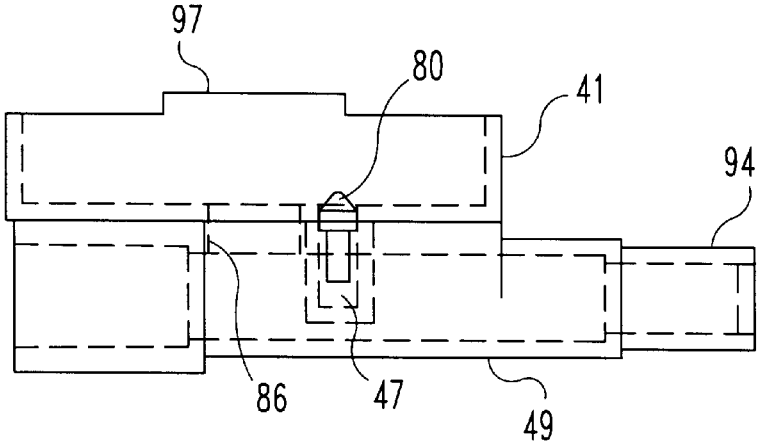
FIG. 7A is a side view of the housing of FIG. 5.

As shown in FIG. 6 chamber 42 further includes index hole 47 for accommodating index spring 82 and pin 80, and chamber 42 includes outlet hole 46 defining the opening of a passage 86 from chamber 42 to barrel 49. With the disk 30 positioned in chamber 42, index holes 34 on disk 30 and index pin 80 preferably cooperate to align one of the disk holes 32 over barrel loading hole 46. With holes 32 and 46 at least substantially aligned, a projectile can transfer, for example under the force of gravity, from disk 30 to barrel 49.

The feed mechanism of the illustrated embodiment also includes means for rotating disk 30 to load projectiles into barrel 49. Accordingly, housing 40 includes trigger portion 44 for holding trigger assembly 52 and allowing sequential movement of assembly 52 therein.

Figure 8:
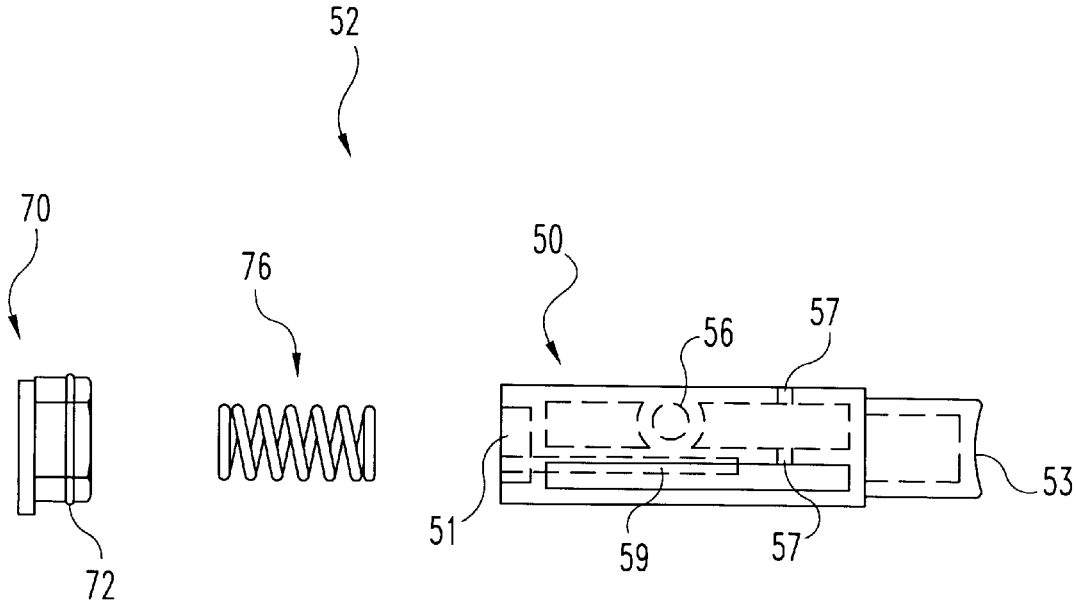
FIG. 8 is a side view of the trigger assembly from the feed mechanism of FIG. 1.
Figure 9:
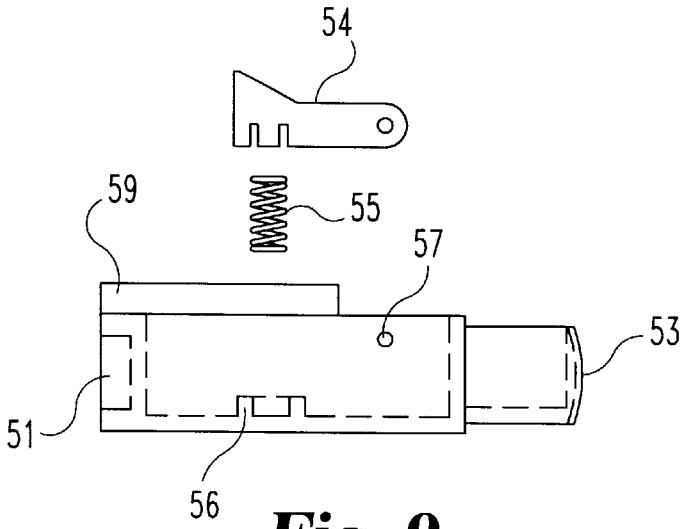
FIG. 9 is a top view of the trigger assembly of FIG. 8.

With reference to FIGS. 8 and 9 trigger assembly 52 generally includes trigger body 50, spring 76, and retaining member 70. Lip 72 on retaining member 70 engages slot 74 in housing 40 to hold assembly 52 in portion 44, and portion 44 includes trigger stops 92 at the other end for containing assembly 52 therein. Portion 44 is sized to allow sequential sliding motion of trigger body 50 in portion 44, with spring 76 normally engaged in hole 51 and biasing trigger body 50 towards stops 92. Preferably finger portion 53 is rigidly connected to the remainder of trigger body 50 and extends beyond stops 92 to be available to be depressed by an operator to providing translational motion to trigger body 50.

Trigger assembly 52 further includes ratchet 54 mounted on the side of trigger body 50 at pivot point 57. When fully assembled, spring 55 is coupled to trigger 50 at mount 56 and biases ratchet 54 away from trigger body 50 and toward lower post 38 and fins 37 of loading disk 30. When the trigger assembly 52 is operated, for example by an operator depressing finger portion 53, ratchet 54 engages fins 37 to rotate disk 30.

Trigger body 50 additionally includes projection 59 extending along at least a portion of its length. Projection 59 is on the same side as ratchet 54 and likewise extends towards post 38 and fins 37 of disk 30. Projection 39 extends along the longitudinal direction of trigger body 50 and is below ratchet 54. Projection 39 is sized and positioned to align with slot 39 on the lower portion of loading disk 30 during the entire operative stroke of trigger 50, providing relative engagement and stabilization therebetween.

Housing portion 44 is shaped to generally correspond to trigger body 50 and to allow for guided lateral movement therein. Portion 44 includes slot 90 to accommodate ratchet 54 and projection 59 during sequential lateral movements of trigger body 50, but portion 44 is otherwise in guiding or supporting relation to trigger body 50.

Housing 40 also preferably integrally includes a barrel portion 49. Barrel portion 49 communicates with chamber 42 through passage 86. Passage 86 terminates in hole 46 and is configured for gravity feed to barrel 49. While in the illustrated embodiment passage 86 is substantially vertical, it is understood that passage 86 can be merely inclined for gravity feeding, or a force feed assembly could be used. To facilitate use as a blowgun, barrel 49 has a mouthpiece end 94 for coupling to a mouthpiece, and barrel 49 has a distal end 99 through which projectiles can be expelled or to which an extended barrel can be coupled. In addition, while barrel 49 is generally rigid with respect to the remainder of housing 40, it is possible to make barrel 49 moveable, for example by forming passage 86 of flexible material or by providing a rotary coupling at one end of passage 86.

Figure 10:
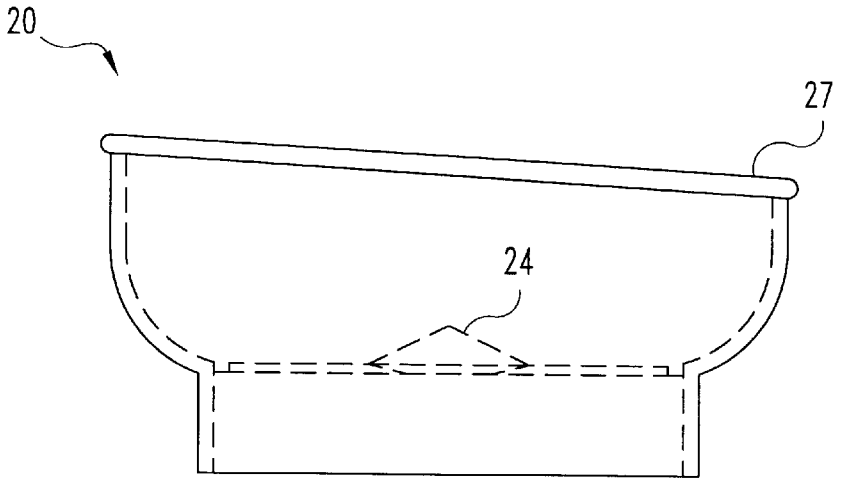
FIG. 10 is a side view of the hopper of the mechanism of FIG. 1.
Figure 11:
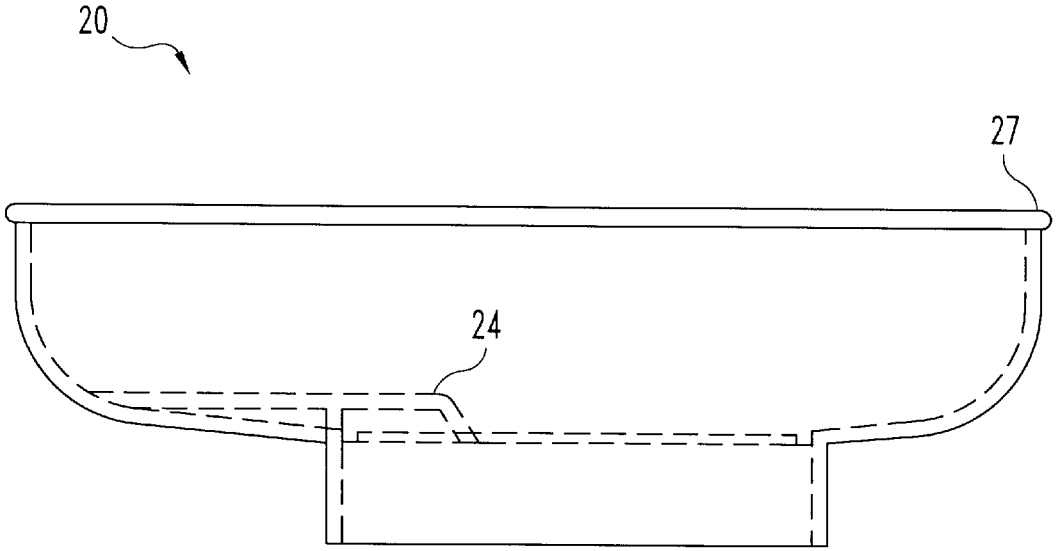
FIG. 11 is a rear view of the hopper of FIG. 10.
Figure 12:
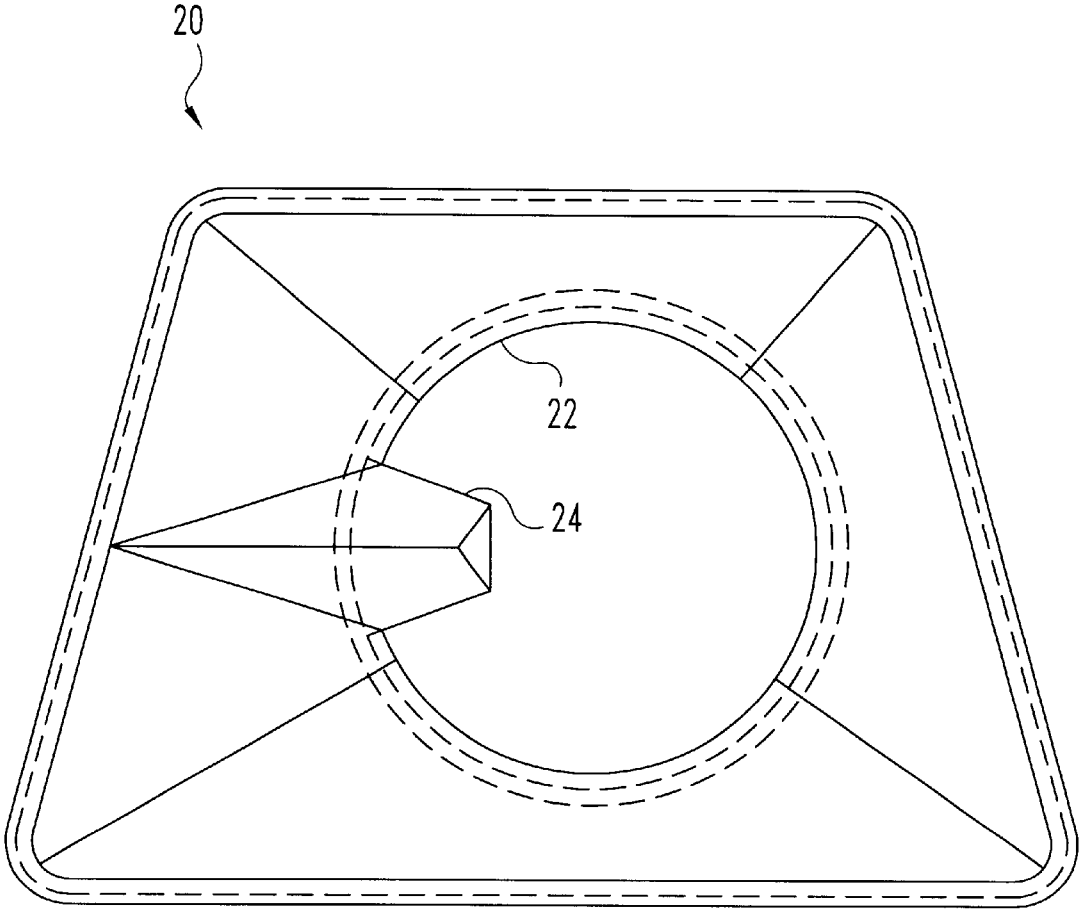
FIG. 12 is a top view of the hopper of FIG. 10.
Figure 13:
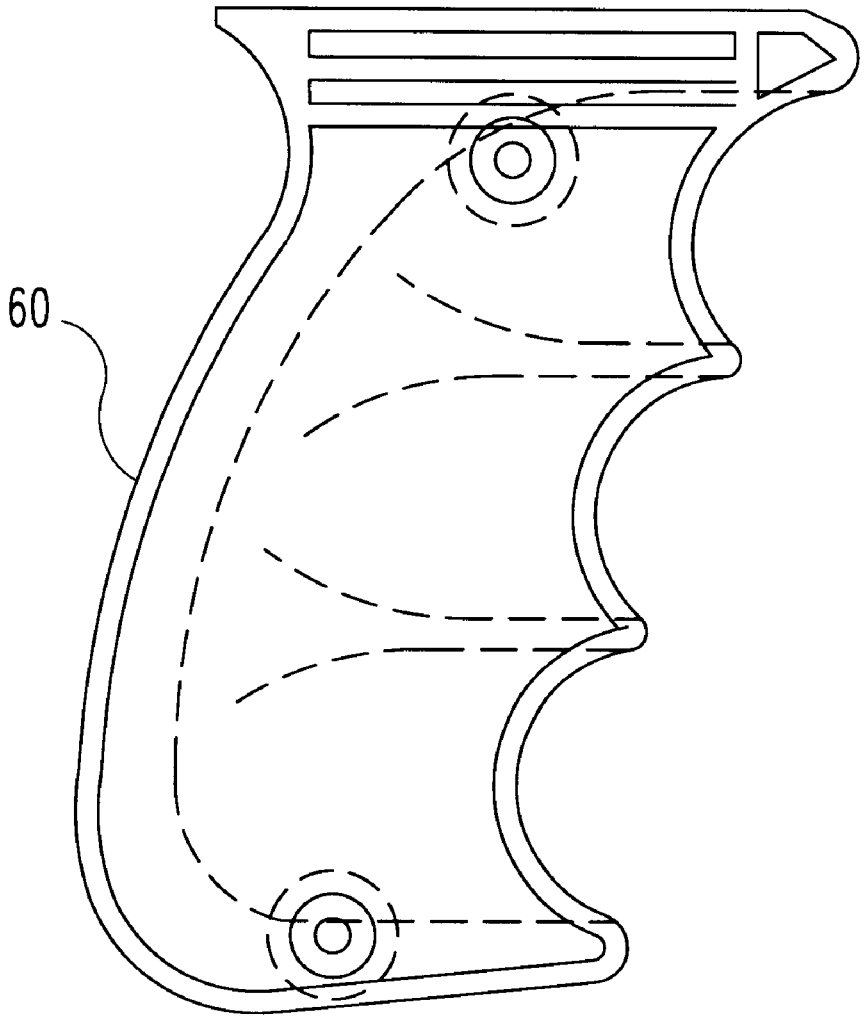
FIG. 13 is a side view of the handle.
Figure 14:
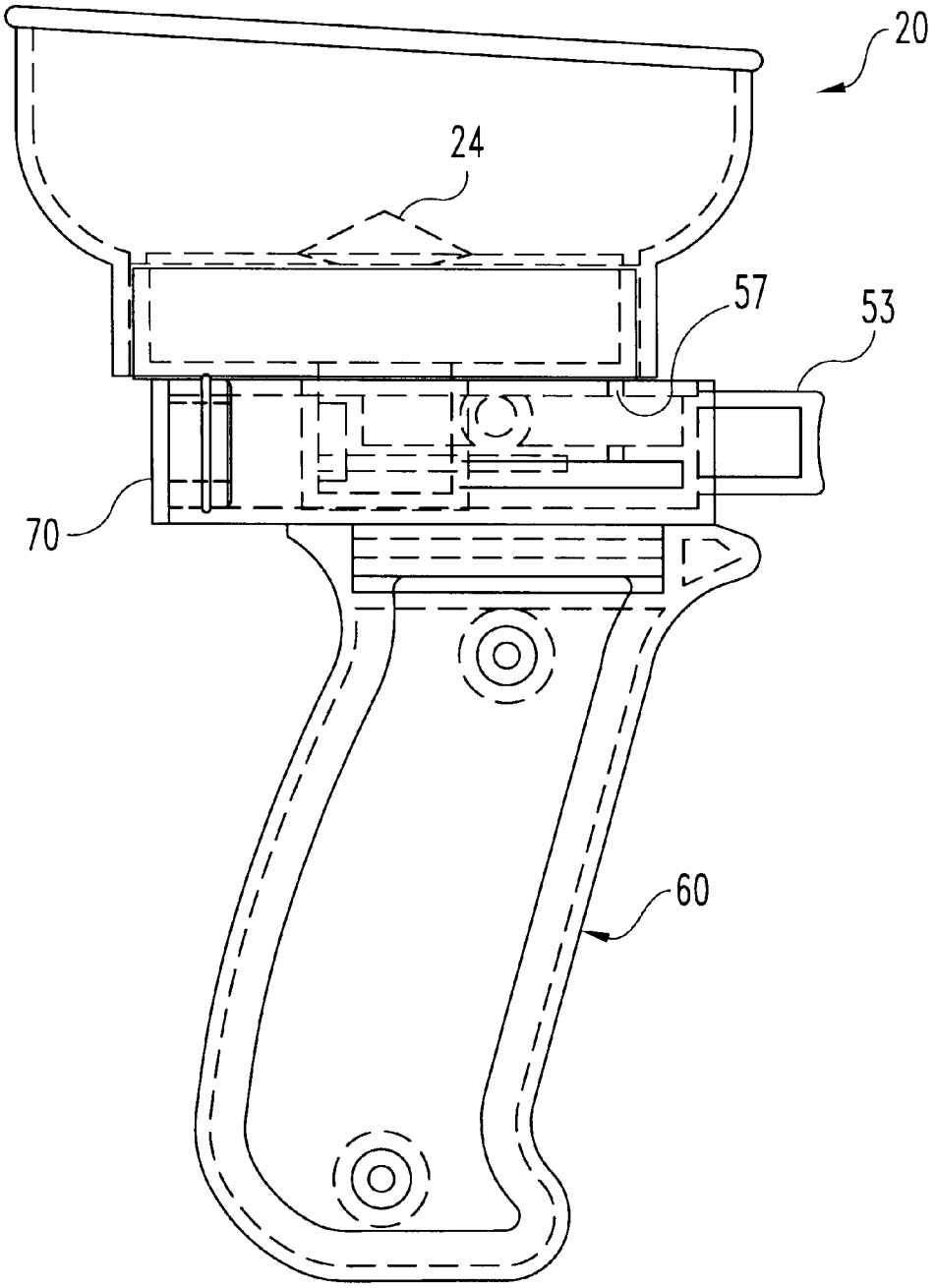
FIG. 14 is a side view of a the partially assembled device of FIG. 1.
Figure 15:
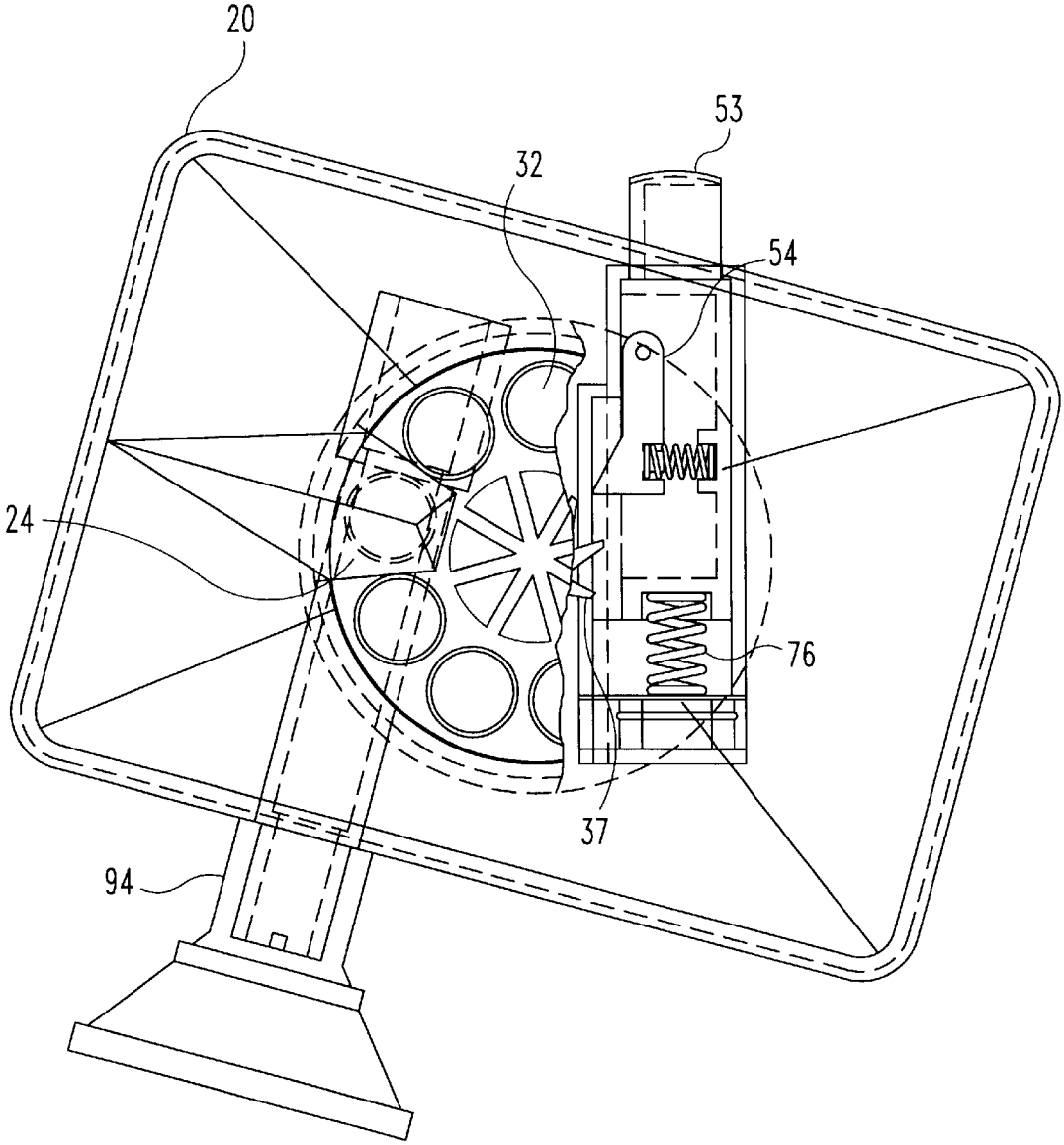
FIG. 15 is a top view of the assembled feed mechanism of FIG. 1 with a partial cutout of the loading disk and including a mouthpiece on the barrel.

Turning now to FIGS. 10–12 hopper 20 is illustrated. Hopper 20 includes top surface 27 which is generally angled downward from left to right as illustrated in FIG. 10. Top surface 27 has a lip to sealingly engage with lid 28. Hopper 20 also includes tab member 24 that is adapted to substantially cover at least one of the holes 32 in loading disk 30. Hopper 20 also includes supporting ring 22 that extends around the lower opening of hopper 20 for resting in supporting relation on top of portion 41. Supporting ring 22 is absent under tab 24 to accommodate and corresponds to raised portion 97 on housing 40, which serves to align hopper 20 such that tab 24 covers a loading disk hole 32 when that hole is in communication with barrel access hole 46.

To be assembled and used, loading disk 30 is first placed into chamber 42. Trigger assembly 52 is then inserted into housing 40 with projection 59 engaging slot 39 on loading disk 30 to anchor and stabilize disk 30 in housing 40. Handle 60 is attached to mount 48.

Hopper 20 is also placed over housing portion 41 with lip 22 resting on the top surface of portion 41 and with raised portion 97 aligned with the underside of tab 24. Hopper 20 is friction or snap fitted on housing 40 and if needed clamped thereon.

With the appropriate mouthpiece installed and an elongated barrel screwed or friction fitted into end 99, the assembly can be used as a multi-shot blowgun. Hopper 20 is filled with a plurality of projectiles, for example paint balls, and lid 28 is secured. Projectiles fill loading disk holes 32, and a single stroke of trigger 50 causes the ratchet 54 to engage a fin 37 to rotate disk 30 from one index position to the next, where pin 80 engages a hole 34 at each index position. At each index position, a hole 32 aligns with barrel access hole 46 to drop a single projectile into the firing barrel 49, tab 24 obstructing other projectiles from proceeding into now aligned holes 32 and 46.

The operator can sight down the barrel axis and over hopper 20 and lid 28 and deliver a puff of air to mouthpiece 95 to fire a projectile out barrel end 99 towards the desired target. The operator also releases trigger 50 which recoils under force of spring 76 to draw ratchet 54 across fins 37 and become positioned for the next projectile delivery. Paddles 36 assist in agitating the projectiles to assure that the remainder of the projectiles in the hopper 20 proceed to individually fill the vacant holes 32 in disk 30.

In other embodiments, disk 30 can be independently mounted in housing 40 without stabilizing slotted interaction with trigger 50. For example disk 30 can be secured to a preformed axle extending vertically from housing chamber 42 with a cotter pin, nut, or the like, and/or disk 30 can be secured by stabilizing interaction with housing 40 or hopper 20.

Likewise, trigger assembly 52 need not engage fins 37 below surface 35 of disk 30. Rather trigger assembly 52 can be adapted to rotate disk 30 by contacting any portion of disk, for example, the sides of disk 30 between surface 35 and surface 33.

Alternative configurations of a manually operated trigger assembly 52 are also contemplated. For example the loading disk can be driven by a gear activated by a pivotally mounted trigger to sequentially drive the disk. Other rotary drive assemblies are also contemplated as would occur to those of skill in the art upon reading the present disclosure.

In one aspect, a paint ball blowgun feed apparatus is constructed to substantially restrict the airflow from barrel 49 to chamber 41 to prevent undesirable air leakage. In this aspect, tab 24 is sized to entirely cover hole 32 when it is aligned with hole 46, with the lower most portion of tab 24 substantially adjacent the top surface 33 of disk 30 surrounding the hole 32. In this way, tab 24 can obstruct at least a portion of the air flow from barrel 49 out the top of the hole 32.

In addition, the lower surface of chamber 42, or at least the portion around barrel access hole 46, is shaped to mirror the shape of bottom surface 35 of disk 30 to minimize or obstruct airflow underneath disk 30 as well. In this regard, surface 35 and the lower surface of chamber 42 are in close relative proximity, for example substantially less than the width of the disk (i.e. the size of a single projectile) and preferably substantially less than half or even a quarter of the disk. In the illustrated embodiment, both the entire lower surface of chamber 42 and bottom surface 35 are each substantially flat and abutting, though other axially symmetric shapes can be utilized as well.

In other embodiments, all airflow into or through chamber 42 and/or disk 30 could be substantially eliminated, for example by providing sealing rings about tab 24 or on the underside of disk 30 or by providing a separate sealing door separating barrel 49 from housing chamber 42. At least where the rotational force for disk 30 is provided manually through manipulation of trigger 50, frictional forces might render sealing rings unpractical.

It is contemplated, however, that alternative means can be used to sequentially rotate disk 30. In one example, a battery powered stepping motor can provide the rotational force, with the motor adapted to index the disk 30 a fixed amount. In other examples, a spring or other mechanical device can store the rotational force to be sequentially released to index the disk 30. In still other alternatives, a combination of stored or motorized forces and manual forces, for example the illustrated trigger assembly 52 or a knob rigidly coupled to the disk 30, may be used as would occur to those of skill in the art upon reading the present disclosure.

In the illustrated embodiment, each of the pieces can be formed as separate pieces of any suitable material, for example metal, hard plastic, synthetic, or a combination thereof. It is also contemplated that individual pieces can be formed together as integral units.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A projectile feeder operatively coupled to a gun barrel, said feeder comprising:

a hopper for containing a plurality of projectiles a housing communicating with said hopper and comprising an outlet, said outlet communicating with a gun barrel;

an indexed loading member mounted at said outlet and having a plurality of yieldingly locked index positions, said loading member defining a plurality of spaces each of which receives a projectile;

a trigger assembly coupled to said loading member to rotate said loading member to one of said index positions, said one index position having one of said spaces over said outlet to transfer a projectile to said gun barrel.

2. The projectile feeder of claim 1 wherein:

said loading member has a bottom surface and said housing has a bottom surface facing said bottom surface of said loading member;

wherein said bottom surface of said housing is in relatively close proximity to said bottom surface of said loading member around said outlet.

3. The projectile feeder of claim 2 wherein:

substantially all of said bottom surface of said housing facing said bottom surface of said loading member is a generally constant distance away from said bottom surface of said loading member, said distance being substantially less than the size of said spaces.

4. The projectile feeder of claim 3 wherein said bottom surface of said housing is generally flat.

5. The projectile feeder of claim 1 wherein:

said outlet of said housing is above the axis of said gun barrel such that said projectile transfers to said gun barrel substantially by force of gravity.

6. The projectile feeder of claim 5 wherein:

said loading member rotates about an axis substantially not parallel to the axis of said gun barrel.

7. The projectile feeder of claim 6 wherein:

said loading member rotates about an axis generally perpendicular to said axis of said gun barrel.

8. The projectile feeder of claim 6 wherein:

said gun barrel is the barrel of a blowgun; and wherein only one of said spaces is placed at said outlet upon a single operative stroke of said trigger.

9. The projectile feeder of claim 1 further comprising:

a tab member over a top surface of said loading member; said tab member substantially covering at least one of said spaces when said at least one space is over said outlet.

10. The projectile feeder of claim 9 wherein said hopper loosely contains a plurality of projectiles for replacing the projectiles in said spaces with a non-predetermined projectile when said spaces are empty.

11. The projectile feeder of claim 1 wherein:

said trigger assembly comprises a trigger member moveably mounted in said housing, and a ratchet member on said trigger member for rotating said loading disk in a single direction upon operation of said trigger.

12. The projectile feeder of claim 11 wherein:

said trigger member is slideably mounted in said housing.

13. The projectile feeder of claim 12 wherein:

said trigger member includes a projection for substantially continually engaging a corresponding slot in said loading member during rotation of said loading member.

14. The projectile feeder of claim 1 further comprising:

an index pin for engaging corresponding index holes to yielding lock said loading member in said index positions.

15. A projectile feeder for a blowgun, said feeder comprising:

a housing comprising an outlet, said outlet communicating with a blowgun barrel;

a loading member rotatably mounted at said outlet with the axis of rotation of said member substantially not parallel to said blowgun barrel, said loading member defining a plurality of spaces each of which receives a projectile, said loading member being selectively positionable with one of each of said plurality of spaces in communication with said outlet to load a projectile into said blowgun barrel;

a manually operated trigger assembly coupled to said loading member to sequentially rotate said loading member a predetermined amount for each operative stroke of said trigger assembly to load a single projectile into said blowgun barrel.

16. The projectile feeder of claim 15 further comprising:

a hopper communicating with said housing for supplying a plurality of projectiles to said housing.

17. The projectile feeder of claim 16 wherein:

said loading member has a bottom surface and said housing has a bottom surface facing said bottom surface of said loading member; and said bottom surface of said housing is in relatively close proximity to said bottom surface of said loading member around said outlet.

18. The feeder of claim 17 wherein:

substantially all of said bottom surface of said housing facing said bottom surface of said loading member is generally flat.

19. The projectile feeder of claim 17 comprising:

a tab member over at least a portion of said top surface of said loading member; said tab member substantially covering at least one of said spaces when said at least one space is over said outlet.

20. The projectile feeder of claim 15 comprising:

an index pin for engaging corresponding index holes to yieldingly lock said loading member in a plurality of index positions.

21. The projectile feeder of claim 20 wherein:

said trigger assembly comprises a trigger member moveably mounted in said housing, and a ratchet member on said trigger member for rotating said loading disk in a single direction upon operation of said trigger.

22. The projectile feeder of claim 21 wherein:

said trigger member includes a projection for substantially continually engaging a corresponding slot in said loading member during rotation of said loading member.

23. A method of loading a gun comprising:

providing a plurality of projectiles and a gun having a gun barrel;

providing a projectile feeder comprising:

a housing having an outlet in communication with said gun barrel;

a loading member defining a plurality of spaces each of which receives a projectile, said spaces being selectively positionable over said outlet;

a hopper for supplying projectiles to said loading member;

a trigger for rotating said loading member to transfer a projectile from one of said spaces to said gun barrel, said trigger not also controlling the firing of said gun;

sequentially indexing said loading member by activating said trigger to drop projectiles into said gun barrel without also causing said gun to be fired by pulling said trigger.

24. The method of claim 23 wherein:

said gun is a blowgun.

* * * * *